US005299623A

United States Patent [19]

Yaffe et al.

[11] Patent Number: 5,299,623

[45] Date of Patent: Apr. 5, 1994

[54] MAGNESIUM DIE CASTING MACHINE

[75] Inventors: Stephen Yaffe, Westmount; Pierre Lamy, Laval; Maurice Doucet, deceased, late of St. Leonard, all of Canada, by Ginette Lefevre, heiress

[73] Assignee: Techmire Ltee./Ltd., Quebec, Canada

[21] Appl. No.: 969,250

[22] PCT Filed: Jul. 26, 1991

[86] PCT No.: PCT/CA91/00259

§ 371 Date: Feb. 19, 1993

§ 102(e) Date: Feb. 19, 1993

[87] PCT Pub. No.: WO92/04147

PCT Pub. Date: Mar. 19, 1992

[30] Foreign Application Priority Data

Aug. 30, 1990 [CA] Canada ..... 2024327

[51] Int. Cl.[5] ..... B22D 17/04; B22D 17/30

[52] U.S. Cl. ..... 164/316; 164/317; 164/318

[58] Field of Search ..... 164/316, 317, 318, 259

[56] References Cited

U.S. PATENT DOCUMENTS

| | | | |
|---|---|---|---|
| 645,438 | 3/1900 | Thompson | 164/316 |
| 936,378 | 10/1909 | Soss et al. | 164/316 |
| 1,800,938 | 4/1931 | Hedly | 164/316 |
| 2,072,864 | 3/1937 | Bauer | 164/318 |
| 2,390,263 | 12/1945 | Mills | 164/316 |
| 3,209,419 | 10/1965 | Deguchi et al. | 164/316 |
| 4,248,289 | 2/1981 | Perella et al. | 164/318 |
| 4,261,414 | 4/1981 | Frenette et al. | 164/316 |
| 4,471,829 | 9/1984 | Perrella et al. | 164/318 |

FOREIGN PATENT DOCUMENTS

| | | |
|---|---|---|
| 515342 | 8/1955 | Canada . |
| 539219 | 4/1957 | Canada . |
| 564340 | 10/1958 | Canada . |
| 757995 | 5/1967 | Canada . |
| 814339 | 6/1969 | Canada . |
| 873237 | 6/1971 | Canada . |
| 922479 | 3/1973 | Canada . |
| 1075874 | 4/1980 | Canada . |
| 1099476 | 4/1981 | Canada . |

*Primary Examiner*—Paula A. Bradley
*Assistant Examiner*—Erik R. Puknys
*Attorney, Agent, or Firm*—David L. Davis

[57] ABSTRACT

A machine for producing metal die castings is disclosed and comprises a crucible that incorporates an injection pump assembly which is mounted in such a way as to clear the upper access of the crucible to facilitate cover sealing and removing. The crucible is located in a furnace and is reciprocable to move the injection barrel and nozzle to and from a mold. The injection barrel is immersed in the crucible beneath the level of the molten metal to enhance heat transfer between the barrel and injected metal. The separate plunger and shot assemblies are located in the pump body in a "V" configuration so that maintenance of these units can be carried out without exposing the top of the furnace to the atmosphere. The plunger and shot assemblies include sealing means in connection with their actuating mechanisms to avoid molten metal splashing outside of the crucible when they are moving in an injection operation and to prevent the ingress of moisture, hydraulic fluid or the like into the crucible or injection chambers. The apparatus is particularly suitable for use with high melting point alloys such as magnesium.

15 Claims, 12 Drawing Sheets

MAGNESIUM DIE CASTING MACHINE

FIELD OF THE INVENTION

This invention relates to die casting machines and in particular to a machine for making castings of high melting point alloys such as magnesium.

BACKGROUND OF THE INVENTION

Die casting with magnesium has increased substantially due mainly to the extreme light weight of the finished parts. On the basis of equal volume, magnesium is approximately less than ¼ of the weight of steel and ⅔ the weight of aluminum. It will be appreciated that light weight in castings is important for numerous reasons some of which are (a) the saving of power and increasing the efficiency of machines that have moving parts; (b) increased payload in the field of transportation. Products made from magnesium tend to dissipate heat much faster than other alloys and accordingly the use of magnesium in the castings of computer cases, RF shielding and the like is most desirable.

Magnesium ages well; it has the approximate weight of plastic with the strength of zinc and it is less expensive than zinc. Casting made from magnesium have good energy absorption qualities and can be machined at higher speeds and with greater economy than any of the other die casting alloys.

There are however inherent problems in the use of magnesium for die casting and these problems usually are centred around the fact that magnesium in a molten state is highly volatile and there is usually a substantial risk of burning and explosion if great care is not taken in handling the molten metal. Desirably, the bath or crucible with molten metal therein should be well sealed from the ambience but this often present problems in locating injection assemblies in the machine. A blanket of inert gas covers the top of the molten metal in the crucible where the metal is maintained in temperatures ranging from 1175° to 1250° F. for the purposes of injection.

Due to some of these inherent problems of die casting with alloys, such as magnesium, production rates have tended to be much lower than those used in the casting of other alloys such as zinc. It will be appreciated that in order to produce an economical die casting, substantial production rates must be maintained. The result of these inherent difficulties has been that, to a great extent, magnesium alloys have not been cast in high speed machines incorporating injection assemblies submerged in the crucible of molten metals.

Canadian Patent 564,340 of Oct. 7, 1958 discloses an apparatus for producing magnesium die castings and it utilizes a "straight" goose neck in which the upper limit of the molten metal in the upper end of the nozzle and the upper surface of the molten metal in the pot is substantially coplanar. An offset arm is pivoted for swinging movement of the complete pot and nozzle toward and away from the surface of the die. This patent utilizes a plunger valve control operated in a vertical sleeve.

The prior art examples mentioned above do not disclose the advanced aspects of the present invention which utilizes an injection pump mounted in a manner so as to clear the upper access of the crucible and facilitate cover sealing and removing for cleaning or purging operations. The prior art does not show an injection pump assembly which comprises two plunger systems, one acting as a spool valve to open and close the injection barrel passage and another one to inject the molten metal into a mold through a barrel passage.

SUMMARY OF THE INVENTION

The present invention strives to provide a substantial advance in the art of die casting with metals like magnesium by addressing the inherent problems of the use of this metal in the die casting field. The machine according to the invention has a cycle time at least as fast or faster than zinc and incorporates an injection assembly submerged in the molten metal but so located and arranged that the injection plunger and an associated spool valve plunger do not interfere with the top of the crucible. Moreover, these units are connected to their actuating means in such a way that they are sealed to avoid the danger of metal splashing outside of the crucible when they are moving in an injection operation, the sealing eliminating any contact between the atmosphere and the molten metal. The injection plunger and the associated spool valve plunger are also constructed so as to seal off any ingress of moisture, hydraulic actuator leaks and the like which might otherwise find their way into the crucible interior. A completely sealed crucible and injecting chamber is the result. The plunger and spool units can, moreover, be removed for cleaning and purging operations without disturbing the cover of the crucible.

The injection assembly incorporates a linear injection barrel, rather than the traditional gooseneck configuration, and which is emerged in the crucible under the level of the molten metal so as to have better heat transfer between the barrel and the metal to be injected.

Rather than the conventional arrangement of moving a gooseneck and nozzle within the confines of the crucible to and from a mold, the present invention incorporates an arrangement where the complete injection assembly including the barrel and nozzle, together with the crucible itself, is moved linearly toward and away from the mold for the purposes of injecting the molten magnesium into the cavities of a die. This arrangement substantially reduces if not eliminates any turbulence on the surface of the molten metal in the crucible which otherwise could cause turbulence in or break the gas layer.

The metal level in the crucible is maintained at an elevation higher than the nozzle and the intake port for introducing molten metal into the plunger or shot chamber is well above the bottom of the crucible, towards the middle of the molten metal supply where the purest metal lies. This inhibits the chance of drawing impurities from the crucible into the shot chamber as the impurities have a tendency to fall to the bottom of the crucible.

The configuration and arrangement of the injection assembly relative to the cover of the crucible; the structural features of the spool valve and plungers; the feature of moving the crucible as well as the injection assembly to and from the mold; and the completely sealed crucible and injection chamber all combine to provide as much safety as possible in a machine that will meet the demanding production figures needed in the industry today.

According to a broad aspect, the invention relates to a machine for producing die castings from metal such as magnesium and comprising a crucible for containing molten metal;

means mounting the crucible on the base of the machine for linear, reciprocal movement of the crucible toward and away from the machine base;

a metal injection pump assembly mounted in the crucible and comprising (a) a pump body secured in the crucible, (b) a pair of plunger units having their lower ends located in the pump body and extending upwardly and outwardly of the body in a "V" configuration so that the upper ends of the units are clear of the upper surface of the crucible, (c) an injection barrel in communication with the plunger units and extending angularly upwardly to terminate in an injection nozzle, (d) one of the plunger units comprising an injection plunger to provide injection pressure to inject molten metal through the barrel into a mold and the other of said plunger units comprising a spool valve to open and close passage into the injection barrel;

cover means sealing the top of the crucible from the atmosphere; and a furnace enveloping the crucible and incorporating means for heating the same.

BRIEF DESCRIPTION OF THE DRAWINGS

The invention is illustrated by way of example in the following in which:

FIG. 9 is a fragmentary plan view of the forward end of the crucible and its manner of mounting;

FIGURE 10 is a sectional elevation view of the apparatus as seen along the line 10—10 of FIG. 11;

FIGURE 11 is an end view, partly in section, of the apparatus of FIGS. 9 and 10 as taken along the line 11—11 of FIG. 10;

FIG. 12 is a side view of the apparatus; and

FIG. 13 is a fragmentary plan view of one side of the crucible guiding means.

DETAILED DESCRIPTION OF THE PREFERRED EMBODIMENT

Figure 1:
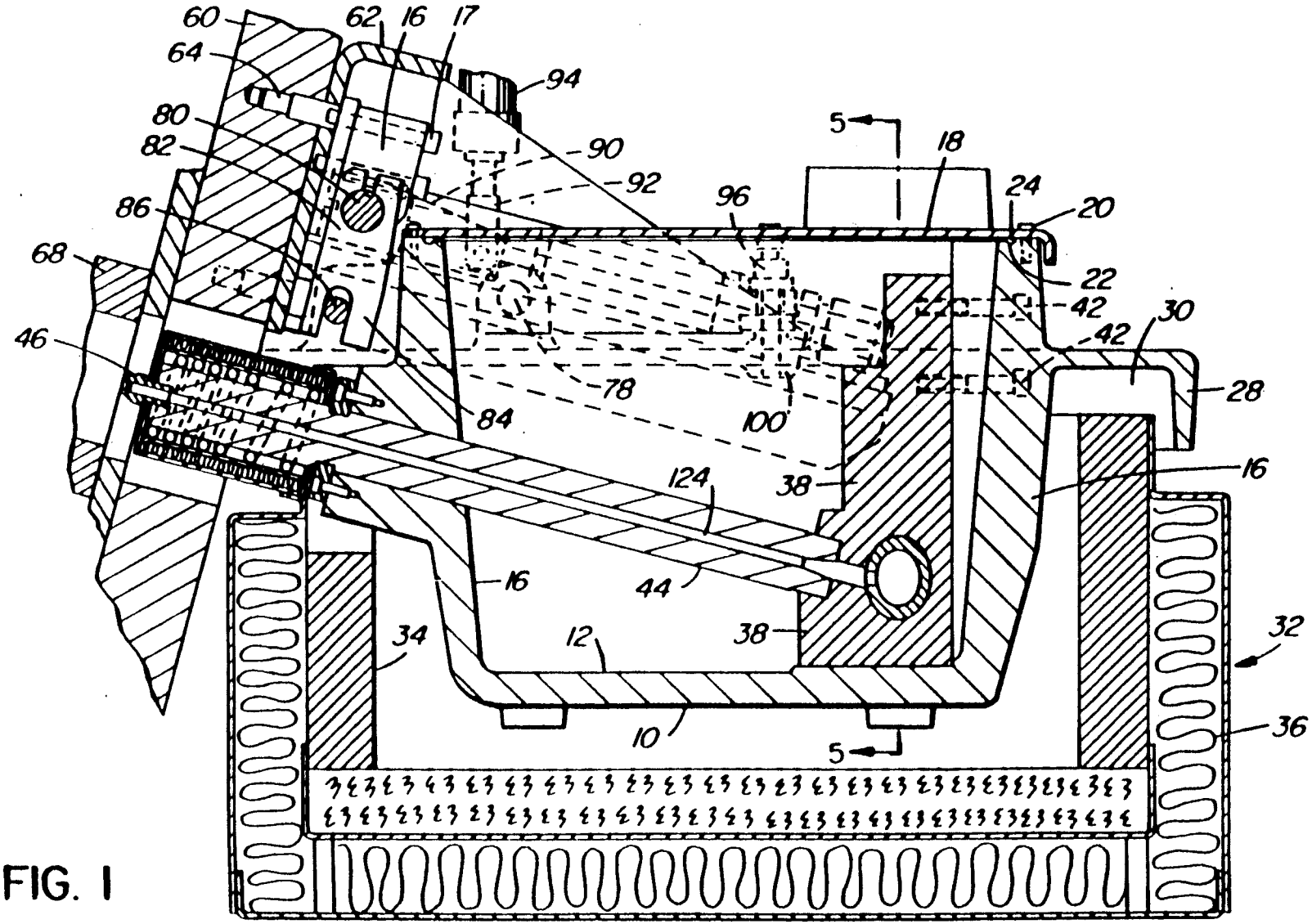
FIG. 1 is a side view, in section, of the crucible of the invention illustrating the barrel and nozzle assembly.
Figure 5:
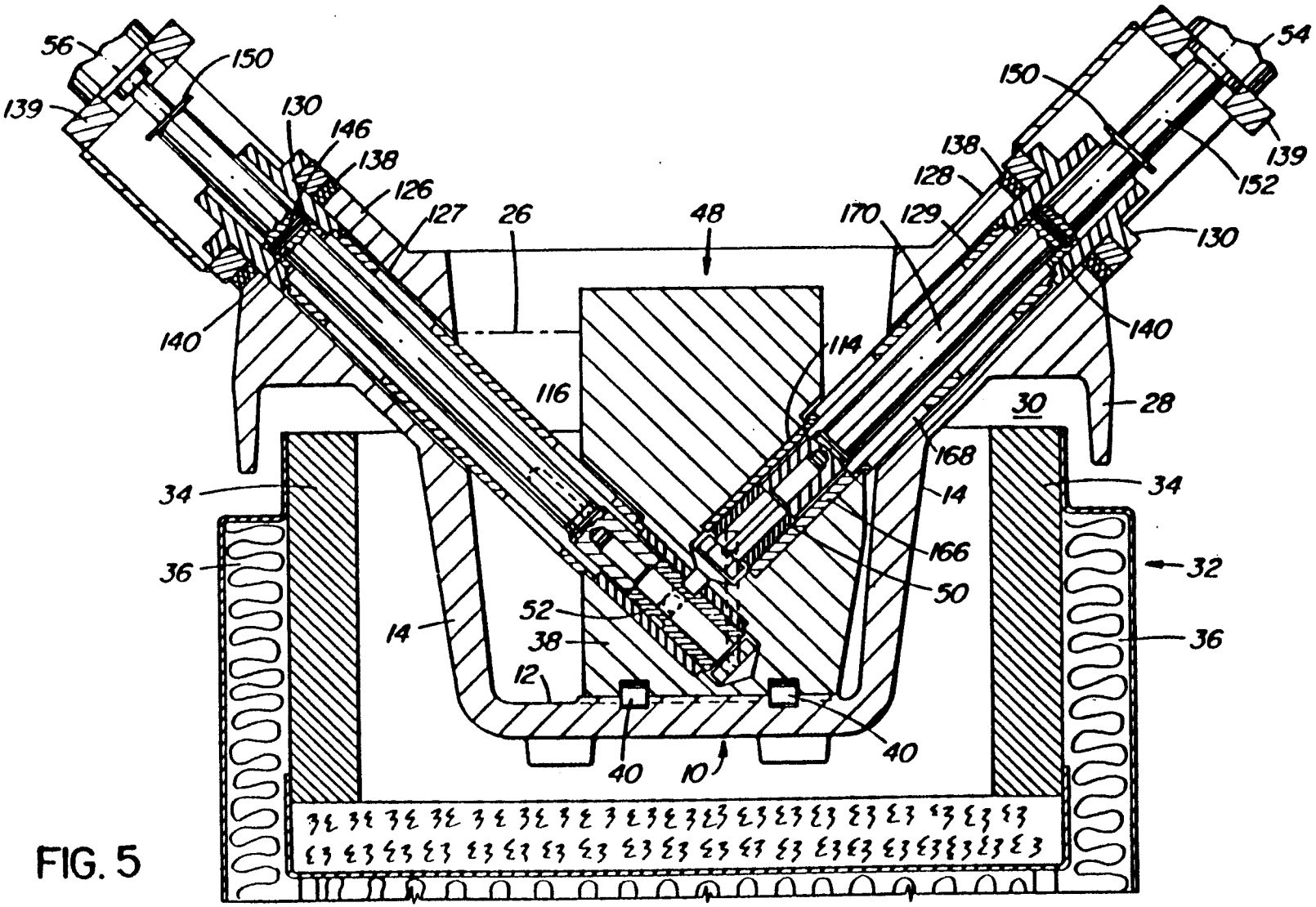
FIGURE 5 is a sectional elevation view taken along the line 5—5 of FIG. 1.
Figure 12:
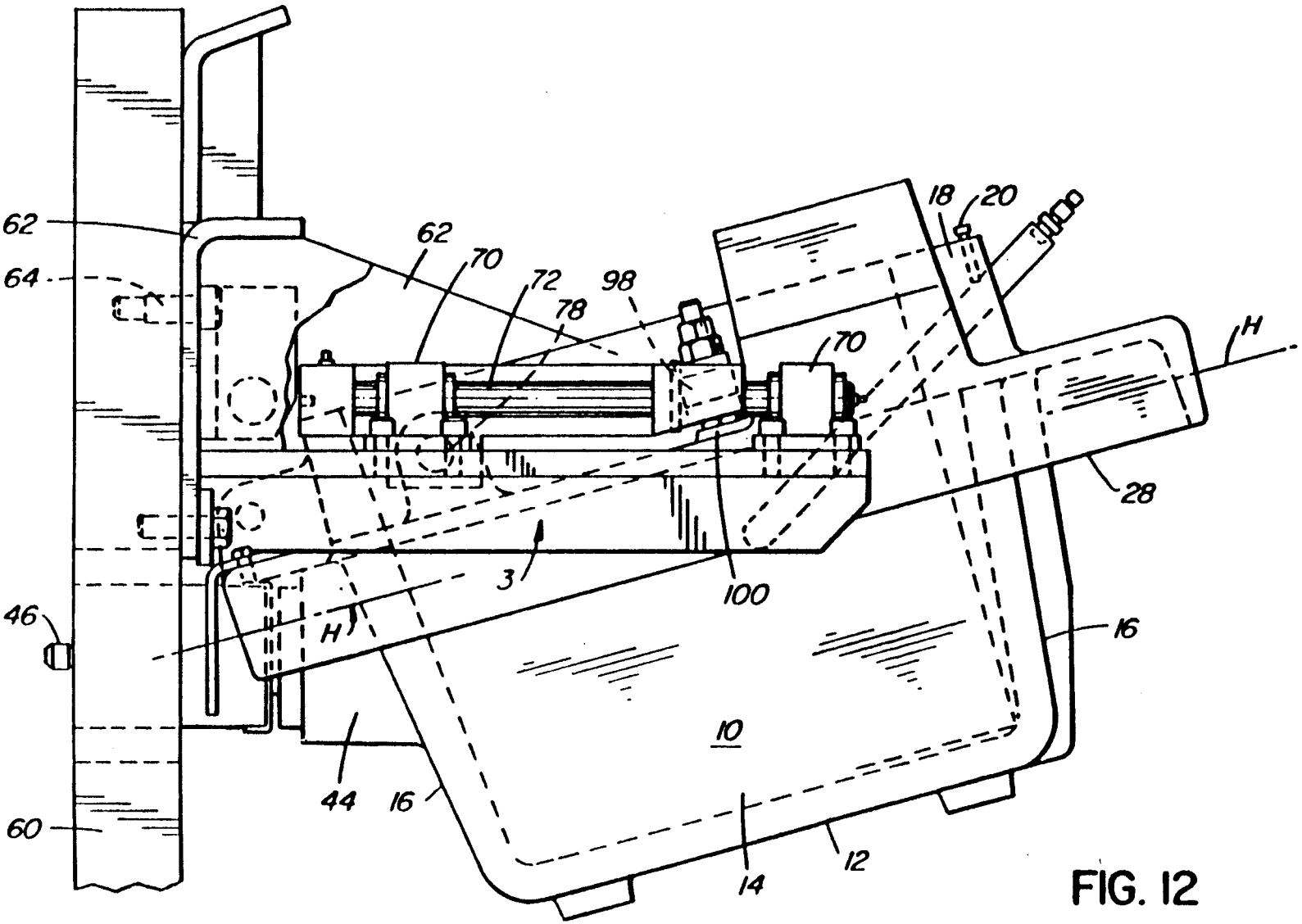

Attention is directed initially to FIGS. 1, 5 and 12 of the drawings. It will be evident that FIG. 1 is a cross-sectional view taken generally through the central longitudinal axis of the crucible, injection barrel and furnace of the machine. FIG. 5 is a cross-sectional view taken generally along the line 5—5 of FIG. 1 to illustrate the injection unit and its relationship with the crucible and particularly the upper surface thereof. FIG. 12 provides a fuller, outside view of the crucible (minus the furnace) and its guiding means.

While this description refers at times to "the machine" it will be appreciated that the present invention is directed mainly to the injection assembly and crucible, the crucible guiding and moving means, furnace and associated mechanisms including the injection nozzle etc. that is adapted to be mounted on and form part of a die casting machine. Apparatus such as the molds of the machine and the mechanism for actuating the molds etc., is not a part of this invention.

As shown in FIGS. 1 and 5, a crucible 10 has a bottom wall 12, sidewalls 14 and end walls 16. A top cover 18 is detachably secured to the upper edges of the side and end walls by means of suitable securing means 20, the upper edge of the crucible having a groove 22 to accommodate a cover seal 24, the purpose of which is to seal the upper surface of the molten metal from the atmosphere. The level of the molten metal in the crucible is indicated at 26 in FIG. 5. Portions of the walls of the crucible have an outwardly and downwardly extending flange 28 defining a pocket 30 for the reception of the upper terminal edge of the sidewalls of a furnace indicated generally at 32 and which comprises heating panels 34 enclosed by heavily insulated walls 36.

A pump body 38 is mounted in the crucible by means of a pair of spaced locating pins 40, FIG. 5, situated on the floor of the crucible and extending upwardly into the base of the pump body 38. Additionally, a pair of spaced bolts 42 secure the upper end of the pump body 38 to the upper rear end wall 16 of the crucible as shown in FIG. 1.

An injection barrel 44 is secured at its lower end to the pump body 38 and extends linearly upwardly therefrom through the front side wall 16 of the crucible and terminates in an injection nozzle 46.

Referring to FIG. 5, the metal injection pump assembly illustrated generally at 48 consists of the aforementioned injection barrel 44, the pump body 38 as well as a pair of plunger units consisting of an injection plunger 50 and a spool valve plunger 52. Plungers 50 and 52 have their lower ends located in the pump body 38 and, as illustrated, each plunger unit is of substantial length and extends linearly upwardly and outwardly of the pump body 38 and crucible 10 to terminate in connection with hydraulic cylinders 54 on the injection plunger and 56 on the injection spool valve assembly. The plunger units are located approximately 90° from one another in a "V" configuration as shown in FIG. 5, this arrangement allowing a relatively undisturbed upper surface of the crucible cover and the layer of inert gas beneath the cover and above the molten metal level 26.

Figure 9:
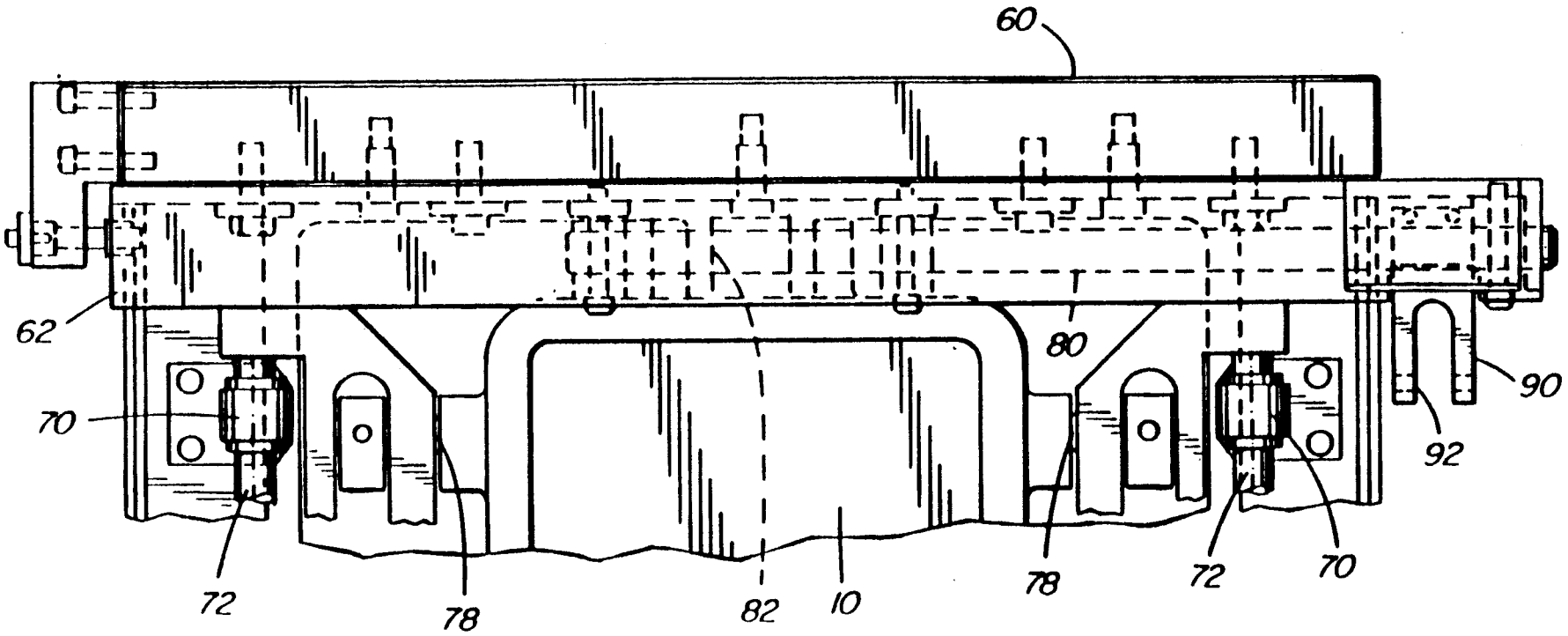
FIGS. 9-13 illustrate the crucible guiding and moving means.

Reference is now made to FIGS. 1 and 12 and the reader will appreciate that FIG. 12 is offset from the true horizontal (dash line H) for purposes of illustration. The crucible 10 is mounted to the rear face of the machine base plate 60 by means of a mounting bracket 62 which extends substantially the width of the base plate as shown in FIG. 9 and which supports the forward end of the crucible guiding and mounting means. Screws 64 secure the bracket 62 to the base 60. The crucible 10 is mounted without any contact with the heating furnace 32 and is located on support means that provide guide means for linearly moving the crucible 10 and its accompanying injection assembly including the nozzle 46, toward and away from a mold mounted on the die casting machine base 60. Moreover, the support means of the crucible provides for the sideways and up and down adjustment of the crucible and therefore the injection barrel 44 and nozzle 46 in relation to an intake runner of the mold 68, as will be described hereafter.

The mechanism for providing this movement and support is shown to some extent in phantom line in FIG. 1, but is best seen in FIGS. 2 and 9–13.

Figure 2:
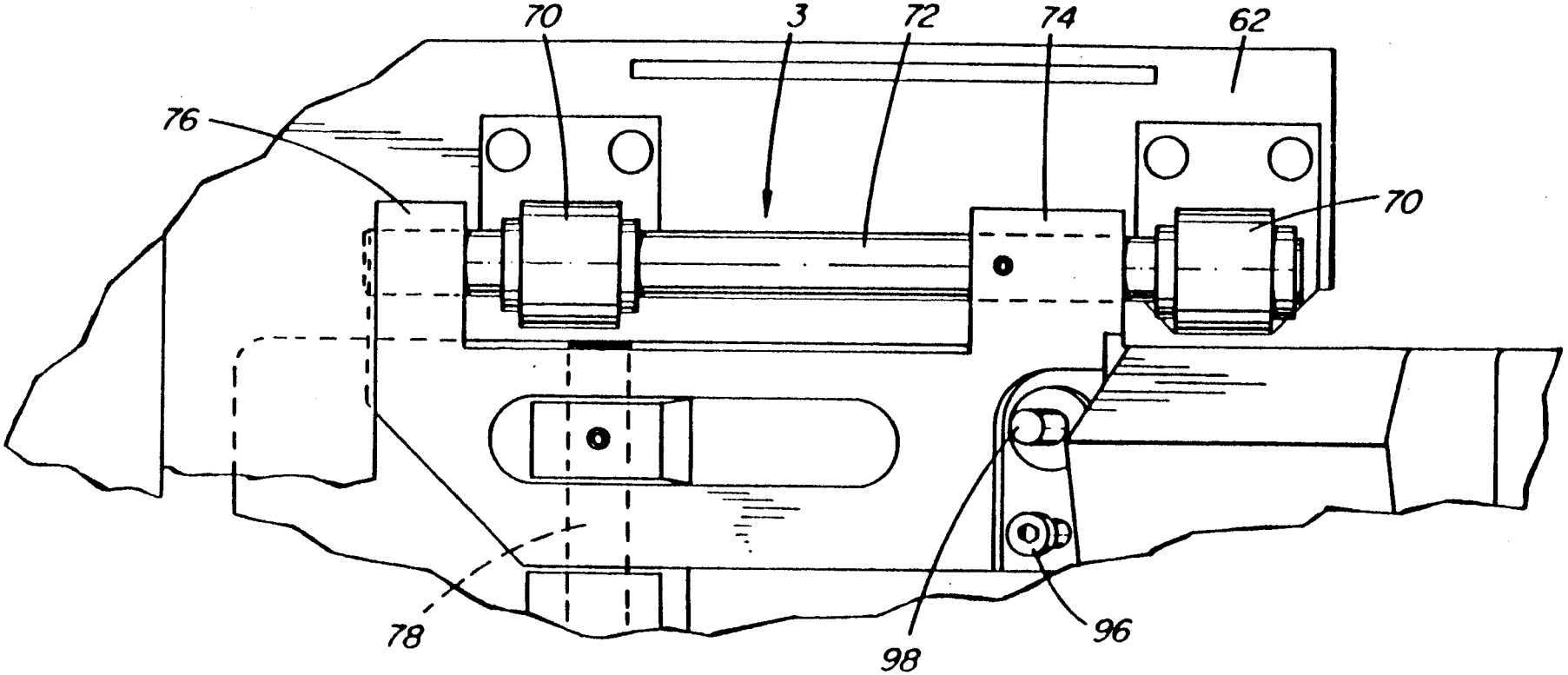
FIG. 2 is a fragmentary, plan view of the crucible side guide.
Figure 13:
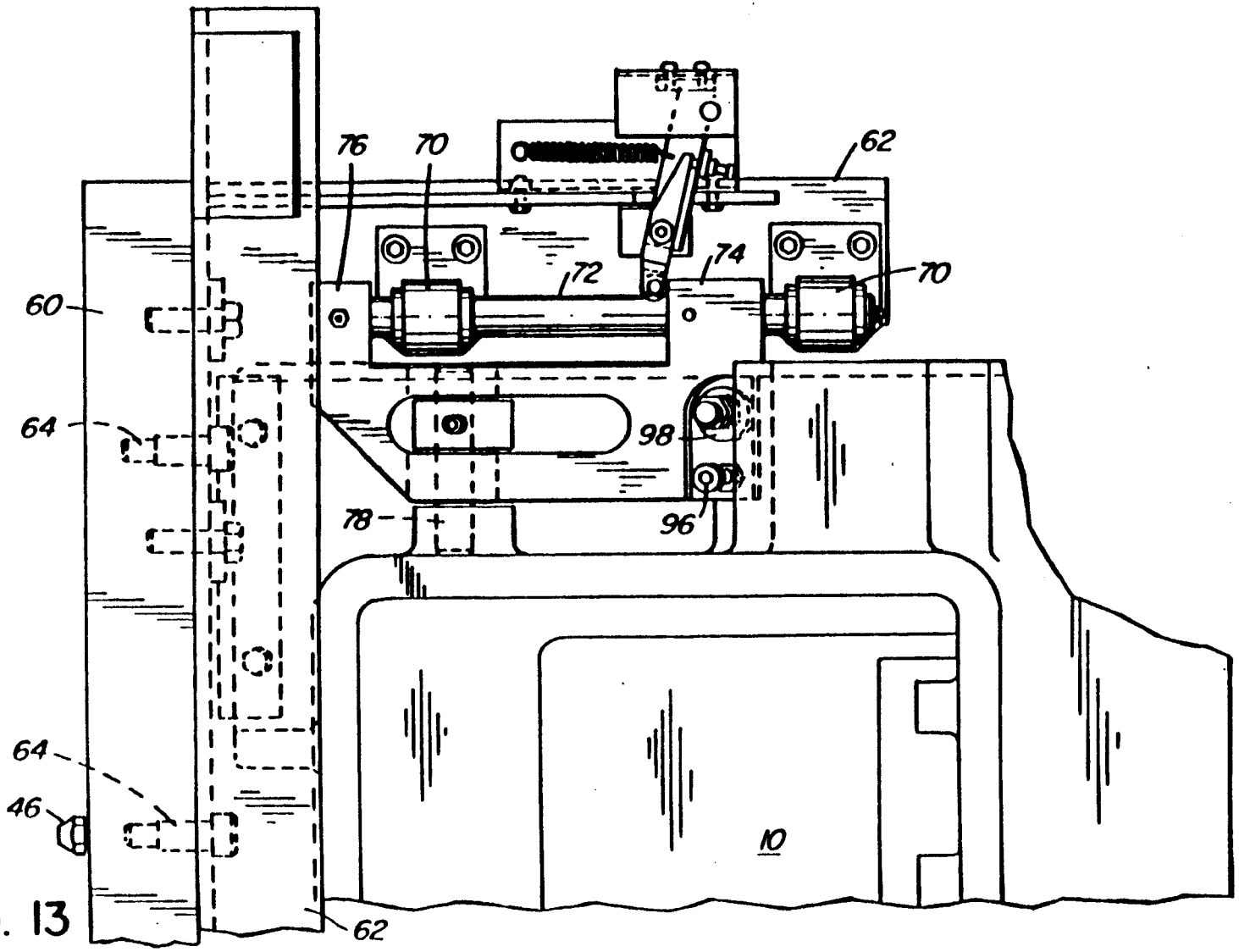

Looking at a combination of FIGS. 1, 2 and 10–12, it will be appreciated that the crucible side guide 3 shown in FIGS. 2 and 12 are provided on each side of the crucible. The crucible mounting bracket 62 is provided on each side with a pair of spaced pillow blocks 70 which support a guiding shaft 72, and also carrying a pair of spaced cruciform side guide brackets 74 and 76. A laterally extending support shaft 78 extends outwardly of the upper sidewalls of the cruciform as shown in FIGS. 2, 9 and 13.

Figure 10:
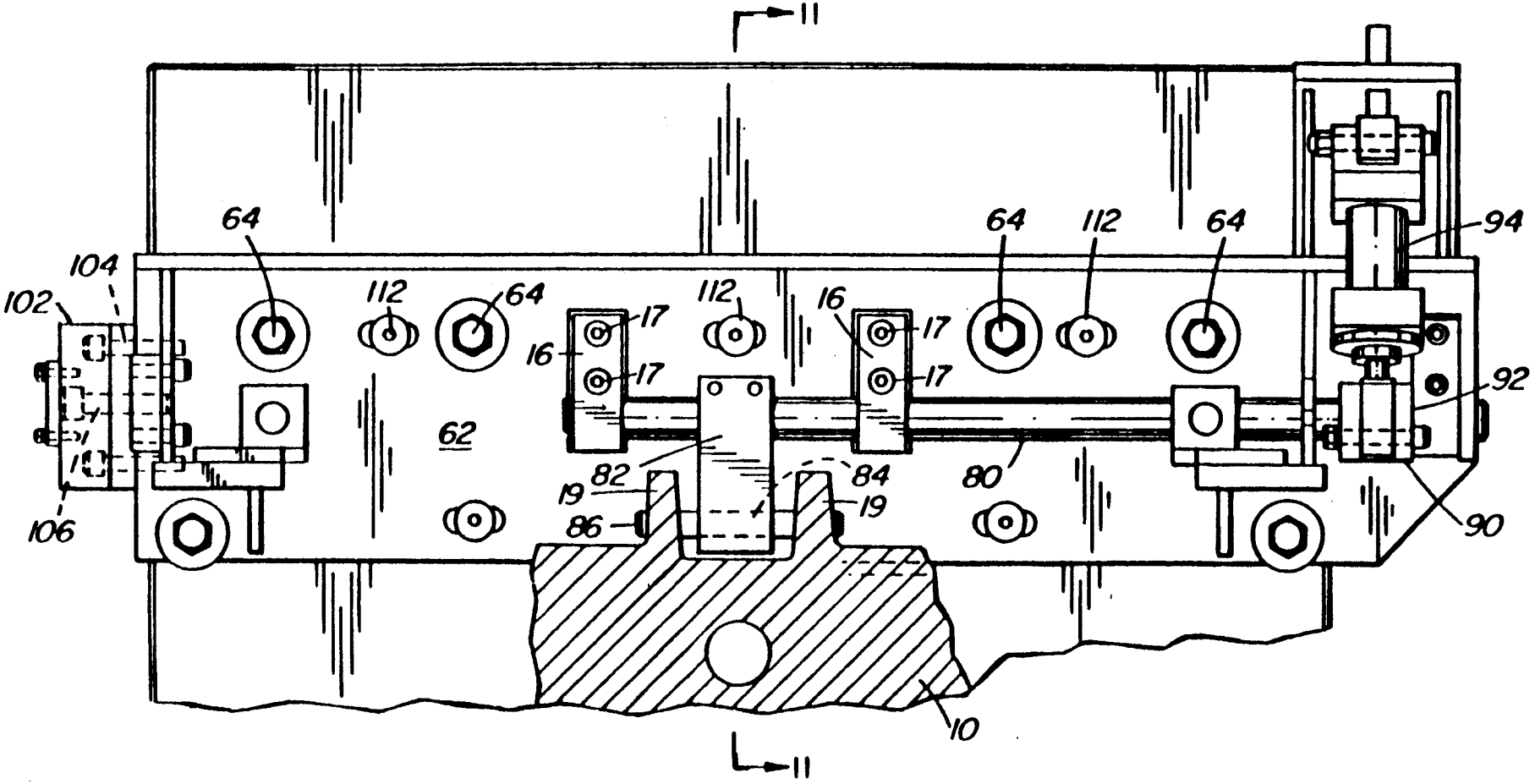
Figure 11:
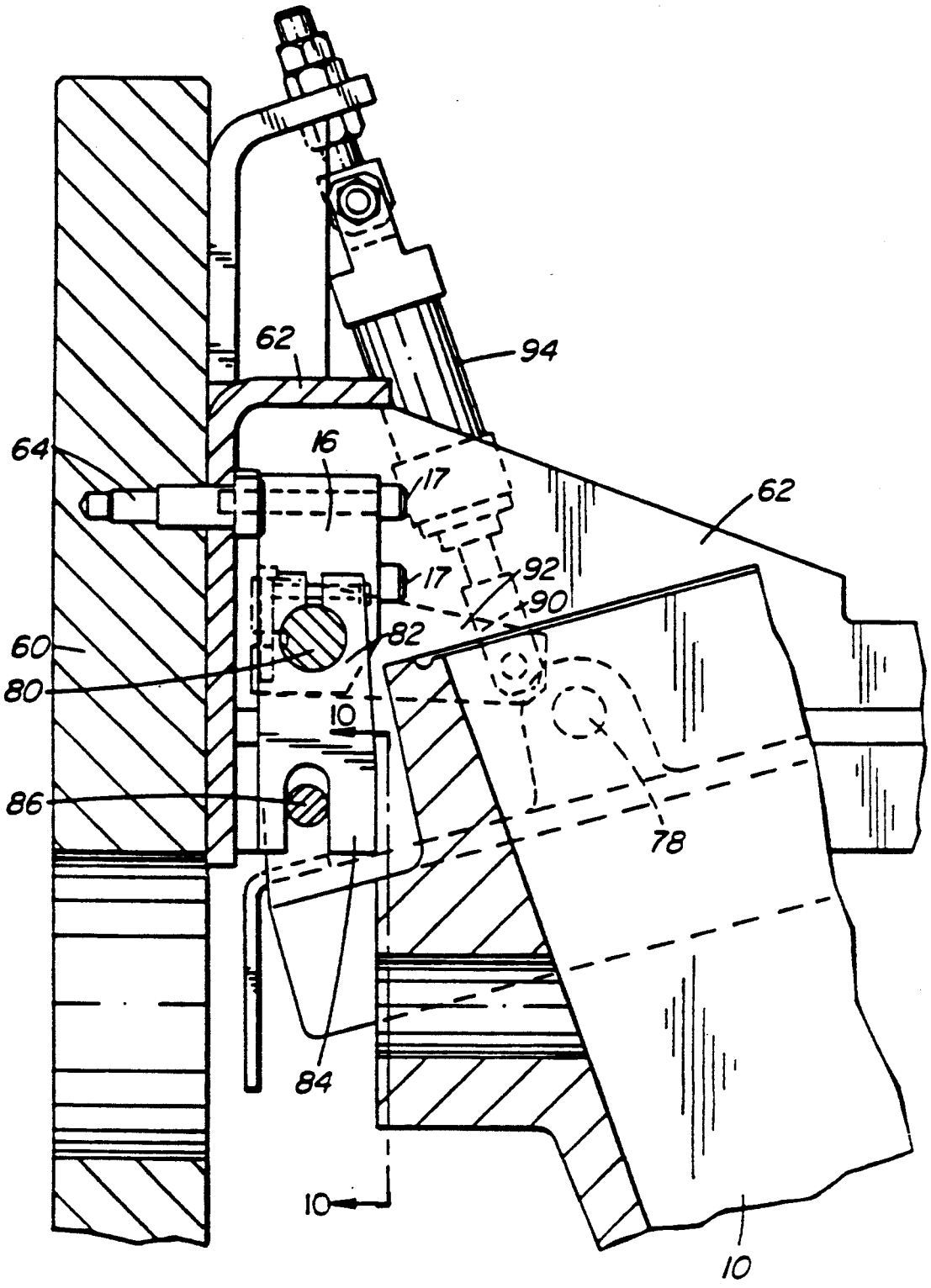

Referring to FIGS. 1, 10 and 11, means for moving the crucible 10 toward and away from the mold 68 comprises a rotatable shaft 80 supported by a plurality of laterally spaced pillow blocks 16 secured to the crucible mounting bracket 62 by means of bolts 17 and secured to the shaft 80 by a moving fork 82 the fingers 84 thereof engaging a fork pin 86 centrally located in spaced lugs 19 on the forward end of the crucible 10 as seen in FIG. 10. An actuating lever arm 90 is secured at one of its ends to the rotatable shaft 80 and its other end has an end yoke 92 for pivotal connection to an actuating cylinder 94.

It will be understood that vertical movement of the cylinder end yoke 92 of the cylinder 94 will have a pivoting effect on the actuating lever arm 90 to thereby rotate the shaft 80 and move the fork 82 and thus the fork pin 86 backward or forward (left or right in FIGS. 1 or 2) thereby moving the crucible and its accompanying structure along the crucible guiding shaft 72 to bring the nozzle 46 into or out of contact with the mold 68.

An up-and-down adjustment is provided between the crucible upper sidewall and the crucible mounting bracket 62. The up and down adjustment comprises a locking screw 96 located along side a threaded shaft 98, the lower end of which engages a seat in the bracket 62. Threading the adjusting screw upwardly or downwardly vertically adjusts the crucible about the support shaft 78, therefore effecting the vertical alignment of the nozzle against the mold.

Figure 3:
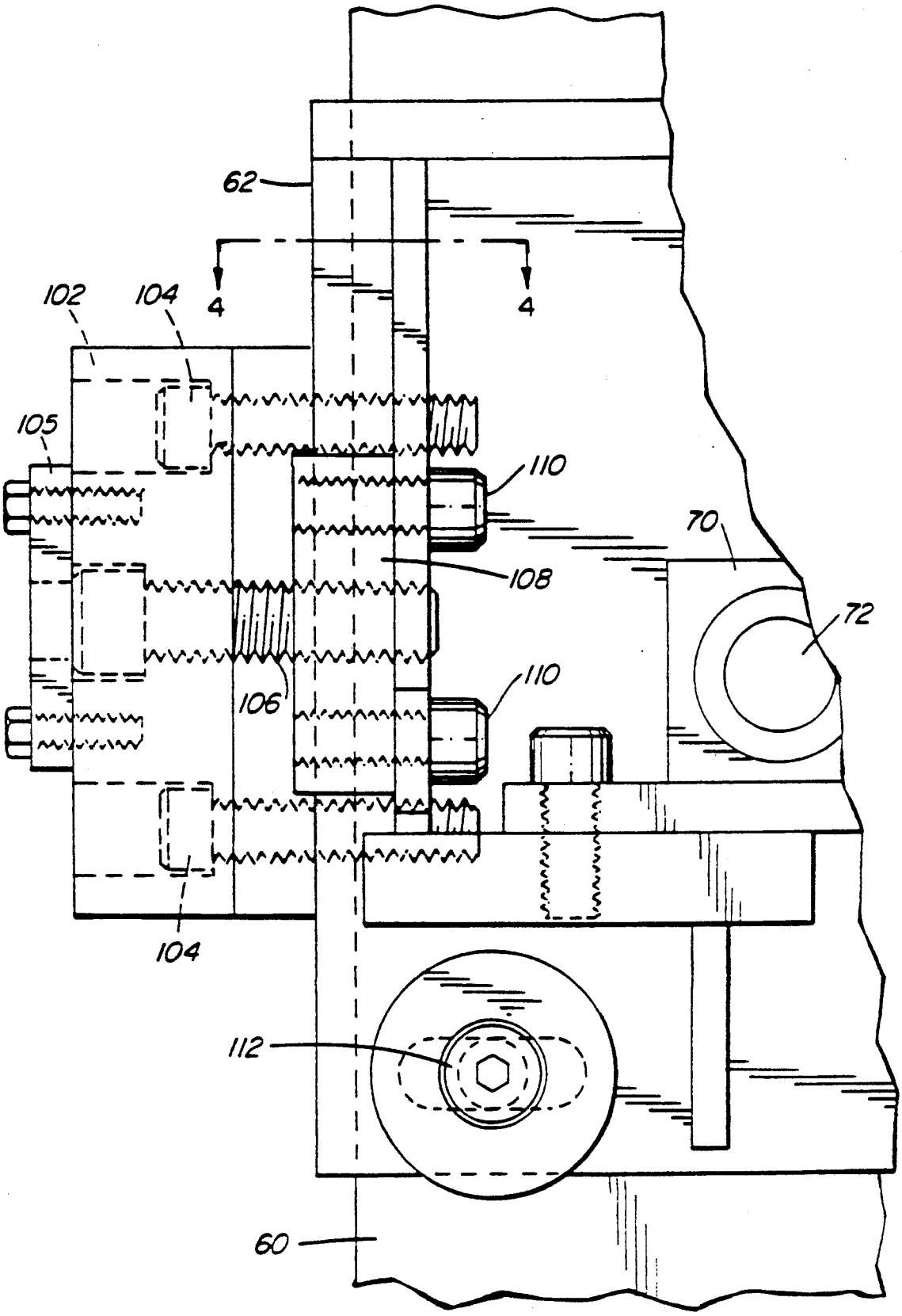
FIGURE 3 is a fragmentary end view of the crucible side ways adjusting means.
Figure 4:
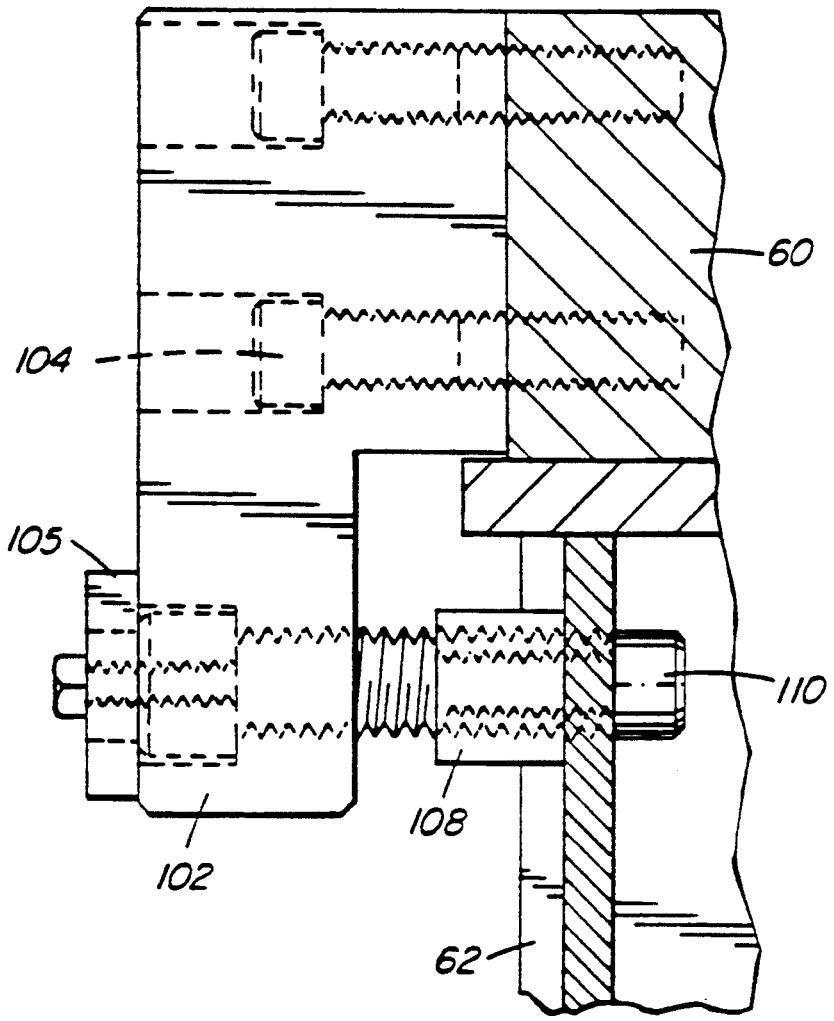
FIG. 4 is a fragmentary plan view taken along the line 4—4 of FIG. 3.

The mechanism for the sideways adjustment of the crucible is shown in FIGS. 3, 4 and 10.

A holding bracket 102 is secured to the machine base plate 60 by means of bolts 104. The sideways adjusting screw 106 has its head portion located in the bracket 102 and is threadably received in a captive nut 108 secured to the crucible mounting bracket 62 by means of bolts 110. The crucible mounting bracket 62 includes a plurality of retainer screws 112 as shown in FIG. 10.

The retaining screws 112 are backed off, and the sideways adjusting screw 106 is rotated one way or another to thereby move the mounting bracket 62 and this the crucible 10 and its accompanying injection assembly laterally along the rear face of the machine base plate 60 and its mounting screws 64.

The metal injection pump assembly is illustrated in FIG. 1 and 5 through 8 inclusive.

Looking initially at FIGS. 1 and 5, the pump body 38 has a pair of bores 114, 116 therein and spaced approximately 45° apart. The uppermost bore 114 receives the injection plunger 50 and its associated mechanism and the bore 116, the lower of the two, receives the injection spool valve 52 and its associated mechanism. The lower end of bore 114 includes a pump chamber 118 therein and this is in communication with bore 116 by way of a passageway 120 formed in the lower end of the injection spool assembly 52, this passageway 120 being formed partly in the spool valve 52 itself and the passageway is also in communication with the passage 124 in the injection barrel.

Briefly, the spool valve assembly is raised or lowered to open or close the injection barrel passage 124 and with the spool valve in the "open" position shown in FIG. 5 in which the injection barrel passage 124 is open, the injection plunger 50, when moved downwardly, forces the molten metal in the chamber 118 through the passageway 120 into the barrel passage 124 through the nozzle 46 and into the mold. After the shot, the spool valve assembly is raised to close off passageway 120 and the injection plunger assembly 50 is raised to effect filling of the shot chamber 118.

Figure 8:
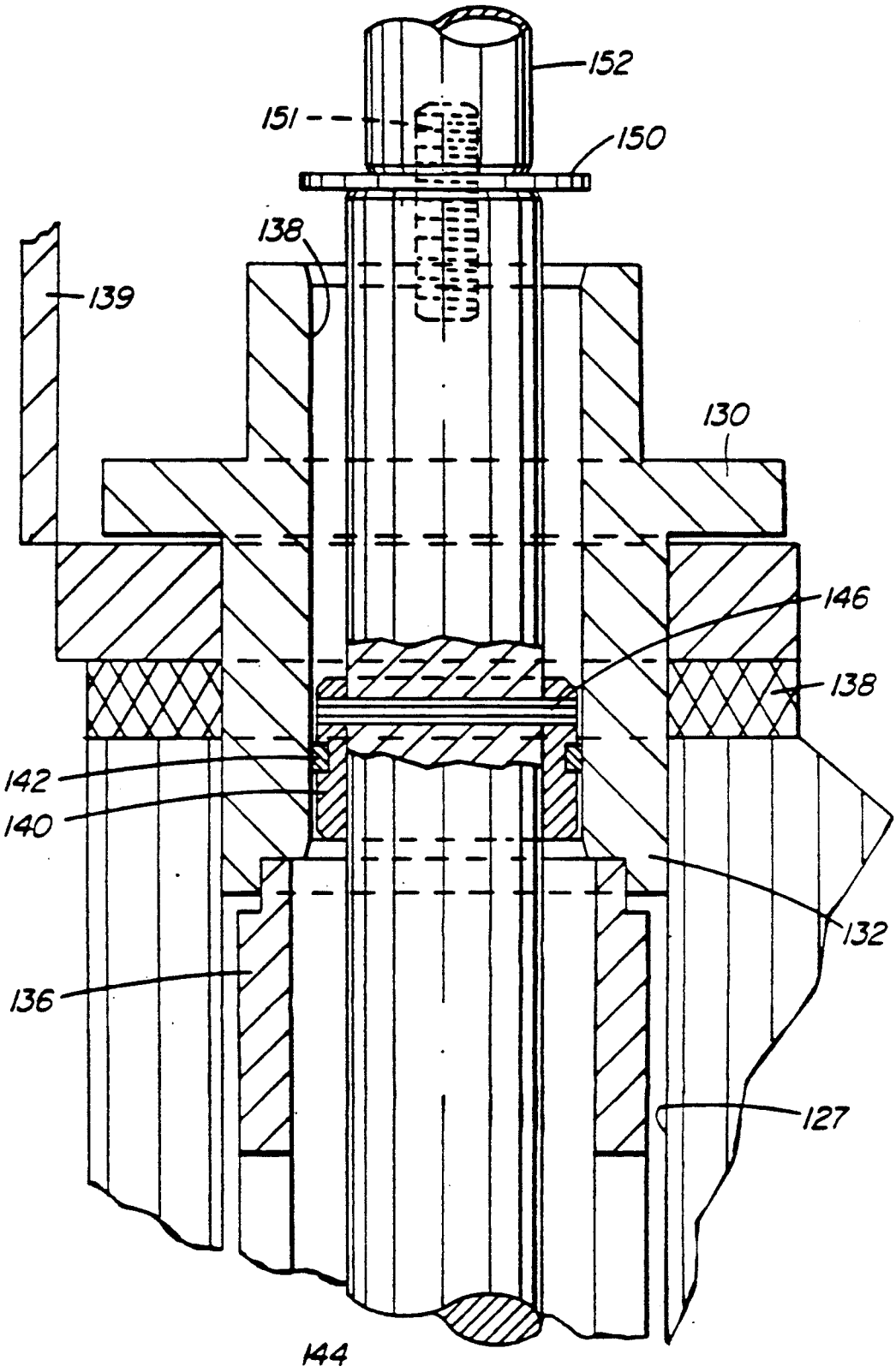
FIGURE 8 is an enlarged view of a segment of FIG. 5.

FIG. 8 shows the upper end structure of either assembly 52 or 50 and provides an enlarged view of the upper ends of the assemblies illustrated in FIG. 5.

Substantial support members 126 and 128 extend upwardly from the sidewall of the crucible 10 and bracket 126 is bored at 127 in alignment with the lower bore 116, bracket 128 being bored at 129 in alignment with the lower bore 114 to accommodate the elongated assemblies 52 and 50. As illustrated, a collar flange 130 has a skirt portion 132 that extends downwardly into bore 127 and has a peripheral shoulder 134 that accommodates the upper end of an elongated cylindrical spool spacer 168.

As described hereafter, both the spool valve assembly 52 and the injection plunger assembly 50 are mounted in the crucible structure in such a way as to avoid metal splashing outside of the crucible when the assemblies are operational. This eliminates contact between the atmosphere and the molten metal. As seen in FIG. 8, the interior of flange 130 provides a cylindrical surface 138 for the reciprocal action of shot piston 140 which is provided with a sealing and wear ring 142. The piston 140 is mounted on the outside of a spool extension shaft 144 by means of a roll pin 146. Piston 140 and ring 142 serve the purpose of sealing in any gases from the crucible area and prevents the escape of such gases to the atmosphere via the assemblies 50 and 52. A circular thermo-gasket 138 provides a seal between the collar of the flange 130 and an arch member 139, the upper end of which supports the spool valve hydraulic actuator 54. A protective washer 150 is secured intermediate the lower end of piston rod 152 of the actuator 54 and the upper end of the injection spool extension shaft 144 which are secured together by stud 151. Washer 150 acts as a deflector to any possible hydraulic leaks from actuators 54 or 56 and prevents any such leaks from entering the cylindrical portion 138 of flange 130 and down into the crucible area. Like numbers apply to the upper end of the injection plunger assembly 50.

Figure 6:
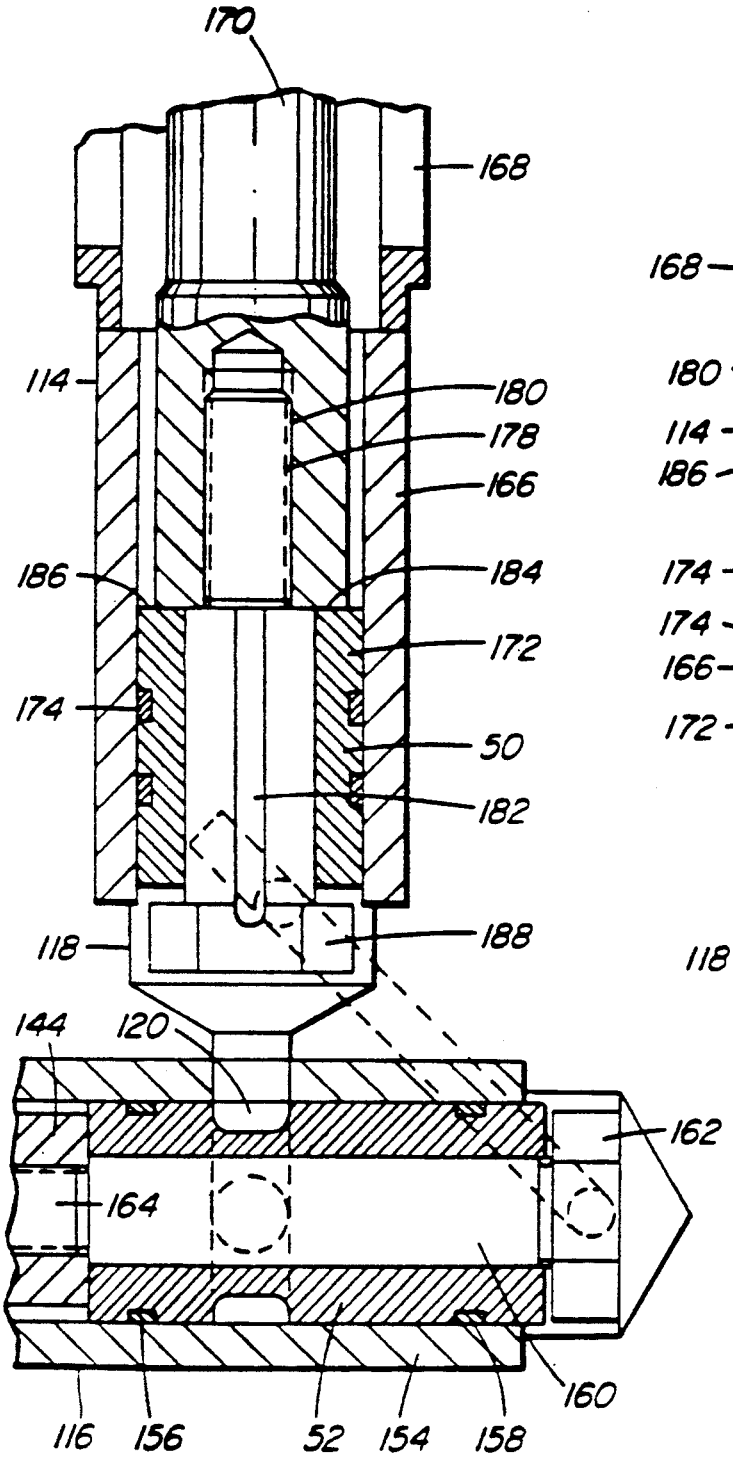
FIGURE 6 is an enlarged sectional view of the injection piston at the lower end of its stroke and illustrating the relationship between it and the associated injection spool.
Figure 7:
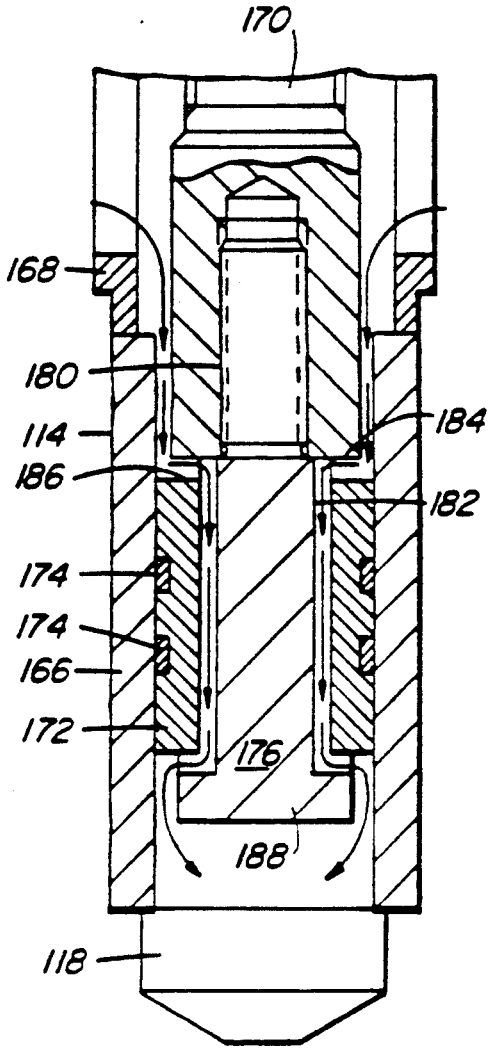
FIG. 7 is another sectional view of the injection piston during travelling loading.

FIGS. 6 and 7 show enlarged views of the spool valve assembly 52 and the injection plunger assembly 50. Looking at these Figures in combination with FIG. 5, injection plunger 50 is of a floating construction and both plunger 50 and valve 52 have peripheral sealing with respect to their mounting means and are moved down to open or close the injection passageways or to make an injection, which ever the case may be. Looking initially at FIG. 6 and FIG. 5, a spool sleeve 154 is positioned in the bore 116 of the pump body to receive the spool valve 52. The latter is provided with upper and lower wear rings 156, 158 and valve 52 is mounted on the shaft 160 of a mounting screw 162 having a threaded end 164 which is received in the lower end of the injection spool extension shaft 144 It will be appreciated that raising or lowering shaft 144 by means of the actuator 56 will at the same time raise and lower the valve 52 in its sleeve 154 to close off or open the passageway 120 between the pump chamber 118 and the barrel passageway 124.

In bore 114 of pump body 38, a sleeve 166 is located and held in place by the lower end of an elongated spacer 168. Likewise, this elongated spacer 168 is firmly engaged at its upper end by shoulder 134 of collar flange 130 as illustrated in FIG. 8.

The injection piston extension rod 170 has its upper end connected to its actuator 54 in the same manner as that of the extension shaft 144 of the spool valve. The lower end however is of different construction. Injection plunger 50 comprises a cylindrical sleeve 172 which has a pair of spaced wear rings 174 for engaging the inner wall of sleeve 166. Plunger sleeve 172 is slidably mounted on a co-axial actuating shaft 176 the upper end of which is threaded at 178 for engaging a similarly threaded socket 180 in the lower end of the extension rod 170. Both sides of the shaft 176 have elongated grooves 182 therein, one diametrically opposed to the other and extending longitudinally of the shaft, parallel with the central longitudinal axis of the unit. These grooves 182 provide communication between the pump chamber 118 and the molten metal in the crucible 10 so that, after a shot is made and the plunger 50 is raised to its FIG. 7 position by its associated actuator 54, the pump chamber 118 will be immediately refilled with molten metal. This action is made possible due to the fact that the injection plunger sleeve 172 is freely mounted or "floats" on the shaft 176. It will be noted that in the FIG. 7 position, the grooves 182 provide a clear passageway for molten metal in the crucible to travel down into the chamber 118 by means of negative pressure in an empty chamber 118, the path of the metal shown by the indicating arrows.

After a shot has been made and the spool valve and plunger 50 are in their FIG. 6 positions, the spool valve is raised (to the left in FIG. 6) to close off passageway 120. It will be seen in FIG. 6 that, in this position, the lower terminal end face 184 of the injection piston extension rod 170 tightly engages the adjacent upper end face 186 of the floating sleeve 172 thereby closing off the grooves or passages 182 on the shaft 176. Sleeve 172 is also at its lowermost position. When extension rod 170 is drawn upwardly it opens up a space between the lower end 184 of the rod 170 and the upper end 186 of the sleeve 172 as shown in FIG. 7, that space widening until the shoulders of the mounting screw 188 engage the lower terminal face of the sleeve 172 to draw the sleeve 172 upwardly within the sleeve 166 as shown in FIG. 7. This action causes a negative pressure in the chamber 118 which quickly fills with molten metal from the crucible 10 along the path indicated in FIG. 7 and explained earlier.

The spool valve, injection plunger and their respective sleeves can be manufactured from any of the commonly used metals but preferably are made from a ceramic material to provide optimum wear resistance and a low friction coefficient.

It will be appreciated that, while the present specification refers generally to the use of magnesium as the casting metal for which the invention is primarily directed, the invention incorporates structural elements which can also be used to advantage in the casting of zinc and other alloys.

While the invention has been described in connection with a specific embodiment thereof and in a specific use, various modifications thereof will occur to those skilled in the art without departing from the spirit and scope of the invention as set forth in the appended claims.

The terms and expressions which have been employed in this specification are used as terms of description and not of limitations, and there is no intention in the use of such terms and expressions to exclude any equivalents of the features shown and described or portions thereof, but it is recognized that various modifications are possible within the scope of the invention claims.

We claim:

1. Apparatus for producing metal die castings comprising:

(a) a crucible (10) for containing molten casting metal;

(b) means (62) mounting said crucible (10) on the base of a die casting machine for linear, reciprocal movement of said crucible (10) toward and away from said machine base;

(c) a metal injection pump assembly (48) mounted in said crucible (10):

(i) characterized in that said metal injection assembly comprises a pump body (38) secured in said crucible, (ii) a pair of plunger units (50, 52) having their lower ends located in said pump body (38) and extending upwardly and outwardly of said body in a "V" configuration whereby the upper ends of said units (50, 52) are clear of the upper surface of said crucible (10), (iii) an injection barrel (44) in communication with the lower ends of said plunger units (50, 52) and extending angularly upwardly and outwardly from said pump body (38) to terminate in an injection nozzle (46) located outside of said crucible (10), (iv) one of said plunger units (50) comprising an injection chamber (118) and an injection plunger (170) to provide injection pressure in said chamber (118) to inject molten metal from said chamber, through said barrel (44) into a mold and the other of said plunger units comprising a spool valve (52) to open and close passage from said chamber (118) into said injection barrel (44), (d) cover means (18) sealing the top of said crucible (10) from the atmosphere; and (e) furnace means (32) enclosing said crucible and incorporating means (36) for heating the same.

2. Apparatus according to claim 1 characterized in that said crucible (10) includes flange means (28) on the rear wall (16) and sidewalls (14) thereof and extending outwardly and downwardly thereof to define a peripheral, inverted pocket (30) for receiving the upper terminal edge of the sidewalls of said furnace (32).

3. Apparatus according to claim 1 characterized in that the top of said crucible (10) includes closure means comprising a groove (22) in the upper peripheral edge of the walls (14, 16) of said crucible (10), a continuous sealing member (24) located in said groove (22), and a cover member (18) detachable secured to said upper peripheral edge and engaging said seal (24).

4. Apparatus according to claim 1 characterized in that the crucible mounting means comprises a mounting bracket (62) extending substantially the width of said base plate (60) and being secured thereto, crucible guiding and mounting means being supported by said mounting bracket (62) and comprising spaced, parallel arms, one on either side of said crucible; a guide shaft (72) supported by each said arm and bracket means (74, 76) on each side of said crucible (10) and mounted for linear movement on said guide shafts (72); said means for applying linear, reciprocal movement to said crucible comprising a rotatable shaft (80) mounted on said mounting bracket (62), parallel thereto; a fork pin (86) centrally located on the forward end of said crucible (10), fork means (82) secured to said rotatable shaft (80) and having fingers (84) engaging said fork pin (86); and an actuator (94) interconnected to said rotatable shaft (80) for rotating the same thereby to move said fork pin (86) and thus reciprocate said crucible (10) along said guide shafts (72).

5. Apparatus according to claim 4 characterized in that means (96, 98, 100) are associated with said crucible sidewall (14) and said crucible mounting bracket (62) for effecting vertical adjustment of said crucible (10) with respect to said base plate (60).

6. Apparatus according to claim 4 characterized in that means (106, 108) interconnect said mounting bracket (62) with said base plate (60) for effecting horizontal movement of the former with respect to the latter and thus horizontal movement between the crucible (10) and said base plate (60).

7. Apparatus according to claim 1 characterized in that said pump body (38) is removably secured in the base of said crucible (10) and includes a pair of bores (114, 116) therein approximately 45° apart; one of said bores (114) incorporating said injection plunger unit (50) and the other of said bores (116) incorporating said spool valve unit (52); an injection chamber (118) in the lower end of said injection plunger unit, a passageway (188) interconnecting said chamber (118) with said injection barrel (44); said spool valve unit (52) being moveable in its' bore to effect opening or closing of said passageway (188); and actuator means (54, 56) associated with each of said units for reciprocating said spool valve unit (52) and for reciprocating said plunger unit (50) to effect an injection of metal from said chamber (118), through said passageway (188) and into and through said injection barrel (44).

8. Apparatus according to claim 1 characterized in that plunger unit support members (126, 128) are integrally formed with and extend angularly upwardly from opposing sidewalls of said crucible (10); bores (127, 129) in said support members (126, 128) in alignment with said bores (114, 116) in said pump body (38); and wherein said spool valve unit (52) and said injection unit (50) each comprises a cylindrical sleeve (154, 166) located in the lower end of its' associated bore; a flange (30) having a cylindrical inner surface secured in the upper end of each support member (126, 128); an elongated tubular spacer (168) located in each said unit bore (114, 116) and having its' lower end engaging said cylindrical sleeve (154, 166), the upper end of said tubular spacer (168) being engaged and secured in place by said collar flange (130); each said actuator (54, 56) being secured to the upper end of said support members (126, 128) and being detachably connected to the upper end of an associated extension shaft (144, 170); piston means (152) mounted on the upper end of each said extension shaft (144, 170) adjacent the upper ends thereof and located in the cylindrical portion of said collar flange (139); and sealing means (140, 142) on said piston means to prevent leakage therepast of gases from said crucible or plunger units.

9. Apparatus according to claim 8 characterized in that means (150) are interposed between the upper end of said extension shafts (144, 170) and said actuators (54, 56) for deflecting any moisture or fluids from entering said cylindrical portions (138) of said collar flanges (130).

10. Apparatus according to claim 7 characterized in that said spool valve (52) is detachably connected to the lower end of said extension shaft (144) and is slidably located in said spool sleeve (154), circumferential sealing rings (156, 158) on said spool valve adjacent each end of said valve and located above and below said passageway (12); said injection plunger (50) comprising an inner cylindrical sleeve (172) having spaced circumferential sealing rings (174) on its outer surface and slidably located in said injection sleeve; actuating shaft means (176) extending coaxially, centrally of said plunger (50) and secured in the lower end of said extension shaft (170); a peripheral shoulder on the head of said actuating shaft (176) and spaced from the end of said extension shaft a distance greater than the length of said plunger, the latter being slidably located on the exterior of said actuating shaft; and longitudinally extending grooves (182) on the walls of said actuating shaft (176) and selectively closed or opened at either end of the plunger sleeve (172) by reciprocal action of the extension sleeve thereby to open or close passage for molten metal between said crucible (10) and said injection chamber (118).

11. Apparatus according to claim 8 characterized in that said spool valve (52) is detachably connected to the lower end of said extension shaft (144) and is slidably located in said spool sleeve (154), circumferential sealing rings (156, 158) on said spool valve adjacent each end of said valve and located above and below said passageway (12); said injection plunger (50) comprising an inner cylindrical sleeve (172) having spaced circumferential sealing rings (174) on its outer surface and slidably located in said injection sleeve; actuating shaft means (176) extending coaxially, centrally of said plunger (50) and secured in the lower end of said extension shaft (170); a peripheral shoulder on the head of said actuating shaft (176) and spaced from the end of said extension shaft a distance greater than the length of said plunger, the latter being slidably located on the exterior of said actuating shaft; and longitudinally extending grooves (182) on the walls of said actuating shaft (176) and selectively closed or opened at either end of the plunger sleeve (172) by reciprocal action of the extension sleeve thereby to open or close passage for molten metal between said crucible (10) and said injection chamber (118).

12. Apparatus according to claim 7 characterized in that plunger unit support members (126, 128) are integrally formed with and extend angularly upwardly from opposing sidewalls of said crucible (10); bores (127, 129) in said support members (126, 128) in alignment with said bores (114, 116) in said pump body (38); and wherein said spool valve unit (52) and said injection unit (50) each comprises a cylindrical sleeve (154, 166) located in the lower end of its' associated bore; a flange (30) having a cylindrical inner surface secured in the upper end of each support member (126, 128); an elongated tubular spacer (168) located in each said unit bore (114, 116) and having its' lower end engaging said cylindrical sleeve (154, 166), the upper end of said tubular spacer (168) being engaged and secured in place by said collar flange (130); each said actuator (54, 56) being secured to the upper end of said support members (126, 128) and being detachably connected to the upper end of an associated extension shaft (144, 170); piston means (152) mounted on the upper end of each said extension shaft (144, 170) adjacent the upper ends thereof and located in the cylindrical portion of said collar flange (139); and sealing means (140, 142) on said piston means to prevent leakage therepast of gases from said crucible or plunger units.

13. Apparatus according to claim 12 characterized in that means (150) are interposed between the upper end of said extension shafts (144, 170) and said actuators (54, 56) for deflecting any moisture or fluids from entering said cylindrical portions (138) of said collar flanges (130).

14. Apparatus according to claim 13 characterized in that said spool valve (52) is detachably connected to the lower end of said extension shaft (144) and is slidably located in said spool sleeve (154), circumferential sealing rings (156, 158) on said spool valve adjacent each end of said valve and located above and below said passageway (12); said injection plunger (50) comprising an inner cylindrical sleeve (172) having spaced circumferential sealing rings (174) on its outer surface and slidably located in said injection sleeve; actuating shaft means (176) extending coaxially, centrally of said plunger (50) and secured in the lower end of said extension shaft (170); a peripheral shoulder on the head of said actuating shaft (176) and spaced from the end of said extension shaft a distance greater than the length of said plunger, the latter being slidably located on the exterior of said actuating shaft; and longitudinally extending grooves (182) on the walls of said actuating shaft (176) and selectively closed or opened at either end of the plunger sleeve (172) by reciprocal action of the extension sleeve thereby to open or close passage for molten metal between said crucible (10) and said injection chamber (118).

15. Apparatus according to claim 12 characterized in that said spool valve (52) is detachably connected to the lower end of said extension shaft (144) and is slidably located in said spool sleeve (154), circumferential sealing rings (156, 158) on said spool valve adjacent each end of said valve and located above and below said passageway (12); said injection plunger (50) comprising an inner cylindrical sleeve (172) having spaced circumferential sealing rings (174) on its outer surface and slidably located in said injection sleeve; actuating shaft means (176) extending coaxially, centrally of said plunger (50) and secured in the lower end of said extension shaft (170); a peripheral shoulder on the head of said actuating shaft (176) and spaced from the end of said extension shaft a distance greater than the length of said plunger, the latter being slidably located on the exterior of said actuating shaft; and longitudinally extending grooves (182) on the walls of said actuating shaft (176) and selectively closed or opened at either end of the plunger sleeve (1272) by reciprocal action of the extension sleeve thereby to open or close passage for molten metal between said crucible (10) and said injection chamber (118).

* * * * *